US008167582B2

(12) United States Patent
Yoo et al.

(10) Patent No.: US 8,167,582 B2
(45) Date of Patent: May 1, 2012

(54) FAN ASSEMBLY AND REFRIGERATOR HAVING THE SAME

(75) Inventors: Myung-Keun Yoo, Seoul (KR); Hyoun-Jeong Shin, Incheon (KR)

(73) Assignee: LG Electronics Inc., Seoul (KR)

( * ) Notice: Subject to any disclaimer, the term of this patent is extended or adjusted under 35 U.S.C. 154(b) by 697 days.

(21) Appl. No.: 12/337,078

(22) Filed: Dec. 17, 2008

(65) Prior Publication Data

US 2009/0185907 A1 Jul. 23, 2009

(30) Foreign Application Priority Data

Jan. 21, 2008 (KR) ..... 10-2008-0006350

(51) Int. Cl.
*F04B 35/04* (2006.01)

(52) U.S. Cl. ..... 417/353; 417/423.1; 417/423.7

(58) Field of Classification Search ..... 313/353, 313/354, 423.1, 423.7; 417/353, 354, 423.1, 417/423.7

See application file for complete search history.

(56) References Cited

U.S. PATENT DOCUMENTS

2003/0210992 A1* 11/2003 Huang et al. ..... 417/366
2004/0033138 A1 2/2004 Jung et al.
2004/0101409 A1 5/2004 Jung et al.
2005/0053493 A1 3/2005 Chung et al.
2005/0132730 A1 6/2005 Lim et al.
2005/0160760 A1 7/2005 Chae et al.
2005/0186088 A1* 8/2005 Chou ..... 417/354
2007/0080604 A1* 4/2007 Yang et al. ..... 310/257
2009/0220360 A1* 9/2009 Zhang et al. ..... 417/354
2009/0257869 A1* 10/2009 Li ..... 415/220

OTHER PUBLICATIONS

U.S. Appl. No. 12/327,039 to Yoo et al., which was filed on Dec. 3, 2008.

U.S. Appl. No. 12/337,110 to Yoo et al., which was filed on Dec. 17, 2008.

* cited by examiner

*Primary Examiner* — Toan Ton
*Assistant Examiner* — Kevin Quarterman
(74) *Attorney, Agent, or Firm* — Ked & Associates LLP

(57) ABSTRACT

A fan assembly. The fan assembly includes a rotation shaft, a rotor coupled to the rotation shaft, a stator disposed inside the rotor, and a fan including a hub having a receiving space therein, and a plurality of blades disposed at a circumference of the hub, and coupled to the rotation shaft such that the rotor is spaced from an inner surface of the hub respectively in axial and radial directions, thereby preventing a transfer of vibration of a permanent magnet to the outside, and thus reducing the generation of noise due to the vibration.

17 Claims, 10 Drawing Sheets

FAN ASSEMBLY AND REFRIGERATOR HAVING THE SAME

CROSS-REFERENCE TO RELATED APPLICATIONS

The present application claims the benefit of Korean Application No. 10-2008-0006350, filed on Jan. 21, 2008, which is herein expressly incorporated by reference in its entirety.

BACKGROUND OF THE INVENTION

1. Field of the Invention

The present invention relates to a fan assembly and a refrigerator having the same, and more particularly, to a fan assembly which can prevent vibration of a permanent magnet from being transferred to the outside and a refrigerator having the same.

2. Description of the Background Art

In general, refrigerators are appliances used to keep items frozen and/or refrigerated therein. A conventional refrigerator may include a refrigerator main body having a cooling chamber therein and a refrigeration cycle device having a compressor and a condenser, for maintaining a cooled state in the cooling chamber.

A machine chamber is disposed at a rear region of the refrigerator main body, and the compressor and the condenser are provided in the machine chamber. A fan for accelerating air flow may also be provided inside the machine chamber so as to facilitate the cooling of the condenser and/or the compressor.

An evaporator for supplying cooling air may be provided at one side of the cooling chamber of the refrigerator main body. A cooling air channel for conducting cooling air to the inside of the cooling chamber via the evaporator may be disposed in the refrigerator main body. A cool air blower fan for accelerating the flow of the cooling air may be provided at the cooling air channel.

As shown in FIG. 1, the fan assembly of the above-mentioned fans may include a fan 10 having a hub 11 and blades 21, a rotor 30 disposed to be received inside the hub 11, a stator 40 disposed inside the rotor 30 with a certain air gap therebetween, and a rotation shaft 50 disposed along a central longitudinal axis of the stator 40 and coupled to the rotor 30 and the fan 10.

A first bearing assembly 55 and a second bearing assembly 60 are provided at the respective ends of the rotation shaft 50 so as to rotatably support the rotation shaft 50. The first bearing assembly 55 is supported by being coupled to a casing (not shown), and the stator 40 is coupled at outer peripheries of each of the first and second bearing assemblies 55, 60.

The fan 10 is provided with the hub 11 having a cylindrical shape and a plurality of blades 21 protruding radially from the outer circumference of the hub 11 and spaced from each other in a circumferential direction. The fan 10 is implemented as an axial flow fan for blowing air in an axial direction and formed to have a propeller shape.

A coupling portion 13 is formed at one end of the hub 11 such that one end of each of the rotation shaft 50 and the rotor 30 is fitted thereinto. The rotor 30 is fitted inside the hub 11 by being closely contacted thereto (e.g., press-fit).

As shown in FIG. 2, the rotor 30 may include a frame 31 having a cylindrical shape and closely coupled at an inner surface of the hub 11, and a permanent magnet 33 coupled to an inner circumferential surface of the frame 31.

With this configuration, when power is applied to the stator 40, a torque is generated by interaction of the stator 40 and the permanent magnet 33, thereby rotating the rotor 30 and the fan 10 centering around the rotation shaft 50.

However, in the related art fan assembly, when the rotor 30 is driven for rotation, an electromagnetic excitation force generated in the air gap between the stator 40 and the rotor 30 vibrates the permanent magnet 33, and the vibration of the permanent magnet 33 is transferred to the outside through the fan 10 coupled directly in contact with the frame 31 housing the permanent magnet 33, thereby generating noise as well as reducing the durability of the constituting elements.

In addition, if the period for use of the fan assembly has elapsed, when the rotor 30 is driven by rotation, a relative rotation of the frame 31 with respect to the rotation shaft 50 may easily occur.

Further, if the permanent magnet 33 is coupled inside the frame 31, the permanent magnet 33 should be inserted inside the frame 31 in an axial direction, with attention to the position of the stator 40 in an axial direction. Accordingly, the insertion and fitting processes require a lot of time and effort, and if the centers of the permanent magnet 33 and the stator 40 are not axially aligned with each other, performance may be reduced.

BRIEF SUMMARY OF THE INVENTION

Therefore, one of the features of the present invention is a fan assembly which can prevent vibration of a permanent magnet from being transferred to the outside, and a refrigerator having the same.

Another feature of the present invention is a fan assembly which can prevent the reduction of a coupling strength between a rotation shaft and a fan, and a refrigerator having the same.

Yet another feature of the present invention is a fan assembly which can prevent a relative rotation of a rotation shaft and a rotor while the rotor and the rotation shaft are rotated, and a refrigerator having the same.

These features may be embodied, as described herein, by a fan assembly, including a rotation shaft, a rotor coupled to the rotation shaft, a stator disposed inside the rotor, and a fan including a hub having a receiving space therein. The fan also includes a plurality of blades disposed at a circumference of the hub. The fan is coupled to the rotation shaft such that the rotor is spaced from an inner surface of the hub respectively in axial and radial directions.

In non-limiting embodiments, the rotor may include a frame having one end thereof open, and a permanent magnet disposed inside the frame.

A rotation-preventing coupling portion for preventing a relative rotation of the frame with respect to the rotation shaft may be provided at the rotation shaft.

The frame may be injection-molded on the rotation shaft.

The fan assembly may also include a permanent magnet coupling portion extending in a radial direction and provided in an inner surface of the frame so as to couple the permanent magnet thereto.

A protruding collar portion protruding outwardly in an axial direction may be provided at a closed end of the frame, and a protrusion receiving portion for receiving the protruding collar portion therein may be provided inside the hub.

In embodiments, the protruding collar portion is formed to have a longer length in the axial direction compared to the protrusion receiving portion.

A stepped portion protruding in an axial direction may be provided at an outer surface of the closed end of the frame so as to have a smaller external diameter than that of the frame.

A recessed receiving portion may be provided in an inner surface of the hub so as to correspond to the stepped portion.

A shaft coupling collar portion protruding in an axial direction may be provided at the hub so as to receive an end of the rotation shaft for coupling therewith.

According to another non-limiting aspect of the present invention, there is provided a fan assembly, including a rotation shaft, a rotor coupled to the rotation shaft, a stator disposed inside the rotor, and a fan including a hub having a receiving space therein. The fan also includes a shaft coupling collar portion protruding in an axial direction at one end thereof so as to be coupled to the rotation shaft, and a plurality of blades disposed at a circumference of the hub, and coupled to the rotation shaft such that the rotor is spaced from an inner surface of the hub respectively in axial and radial directions.

In non-limiting embodiments, the shaft coupling collar portion may be slotted at an end portion thereof.

A non-contact clearance space may be provided inside the shaft coupling collar portion such that an inner surface of the shaft coupling collar portion is spaced from an outer surface of the rotation shaft.

A coupling member may be elastically coupled to the shaft coupling collar portion and configured to apply an elastic force urging the shaft coupling collar portion into contact with the rotation shaft.

The coupling member may be coupled to an outside of the non-contact clearance space.

According to still another non-limiting aspect of the present invention, there is provided a refrigerator having the fan assembly.

While the present invention is described herein as being used with refrigeration systems, it is not limited to such applications. In this regard, the present invention further contemplates use of the fan assembly in, but not limited to computer systems, HVAC systems, automotive applications, alone, and other known cooling and heating systems.

The foregoing and other features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the present invention, are incorporated in and constitute a part of this specification. The drawings illustrate non-limiting embodiments of the present invention and together with the description serve to explain the principles of the invention.

In the drawings.

DETAILED DESCRIPTION OF THE INVENTION

Description will now be given in detail of a fan assembly and a refrigerator implementing the same according to non-limiting embodiments of the present invention, examples of which are illustrated in the accompanying drawings. Although some embodiments are illustrated herein, it should be understood that numerous other modifications and embodiments can be devised by those skilled in the art that will fall within the spirit and scope of the principles of the present invention.

Figure 1:
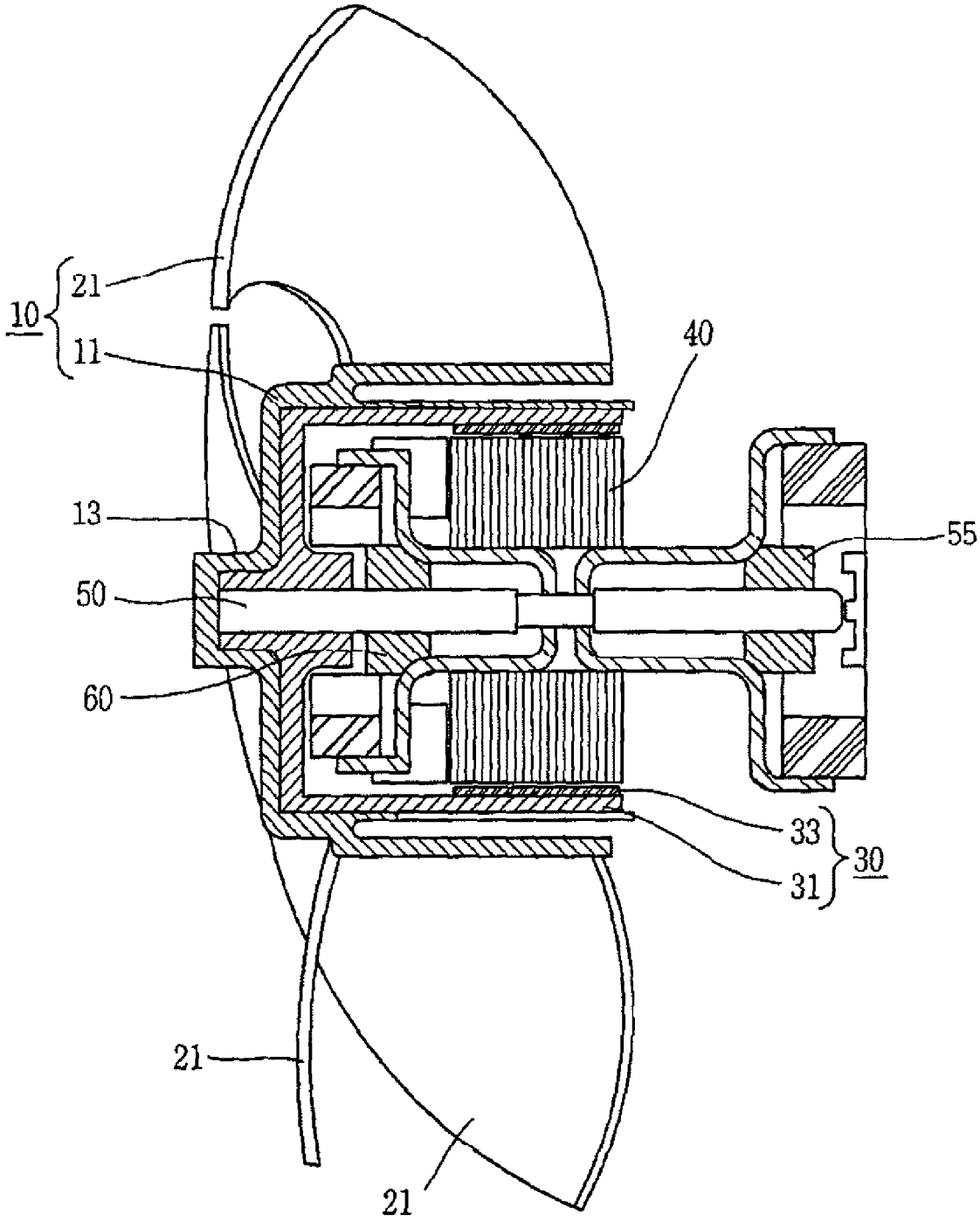
FIG. 1 RELATED ART
FIG. 1 is a cross-sectional view of a related art fan assembly.
Figure 2:
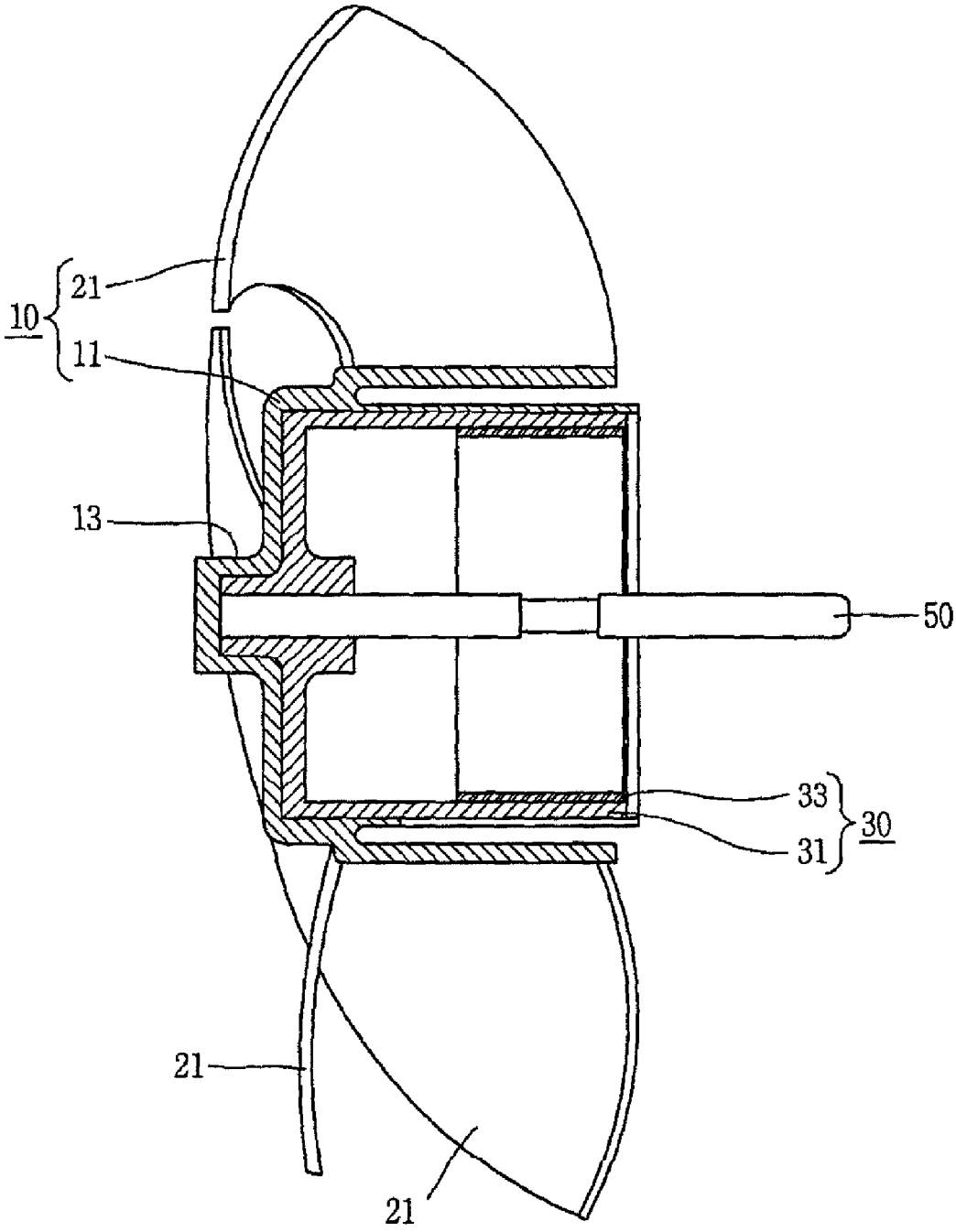
FIG. 2 RELATED ART
FIG. 2 is a cross-sectional view illustrating certain parts of the fan assembly in FIG. 1.
Figure 3:
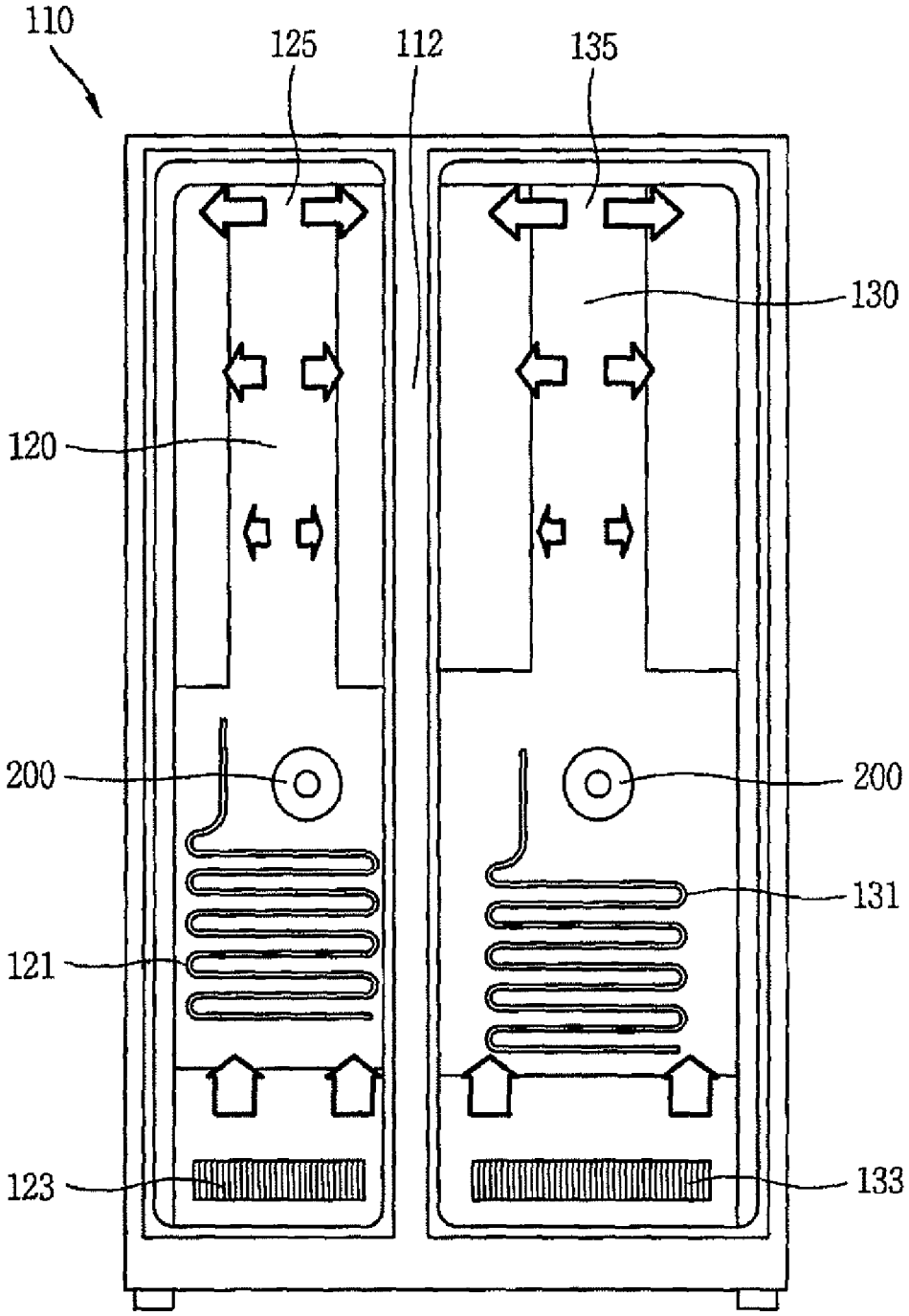
FIG. 3 is a cross-sectional view illustrating an inside of a refrigerator implementing a fan assembly according to a non-limiting embodiment of the present invention.

Referring to FIG. 3, a refrigerator implementing a fan assembly according to the present invention may include a refrigerator main body 110 having a freezing chamber 120 and a cooling chamber 130 separated by a partition wall 112 therebetween. A freezing chamber door (not shown) and a cooling chamber door (not shown) are coupled to a front surface of the refrigerator main body 110 for opening/closing the interiors of the freezing chamber 120 and the cooling chamber 130. A fan assembly 200 is disposed at each of the freezing chamber 120 and the cooling chamber 130, respectively, so as to blow cooling air. Here, each fan assembly 200 may be disposed to cool a condenser and/or a compressor of a machine chamber (not shown) of the refrigerator main body 110. In alternative embodiments, the fan assembly 200 may be disposed at the freezing chamber 120 only.

Evaporators 121, 131, through which air is cooled by heat-exchange thereat, are disposed at rear lower regions of the freezing chamber 120 and the cooling chamber 130, respectively. Cooling air inlets 123, 133 through which air inside the freezing and cooling chambers 120, 130 can be introduced are provided below each of the evaporators 121, 131.

The fan assemblies 200 are respectively disposed above each evaporator 121, 131, and cooling air ducts 125, 135 each having a cooling air channel therein are respectively disposed above the fan assemblies 200 such that cooling air having passed the evaporators 121, 131 can flow upwardly.

Figure 4:
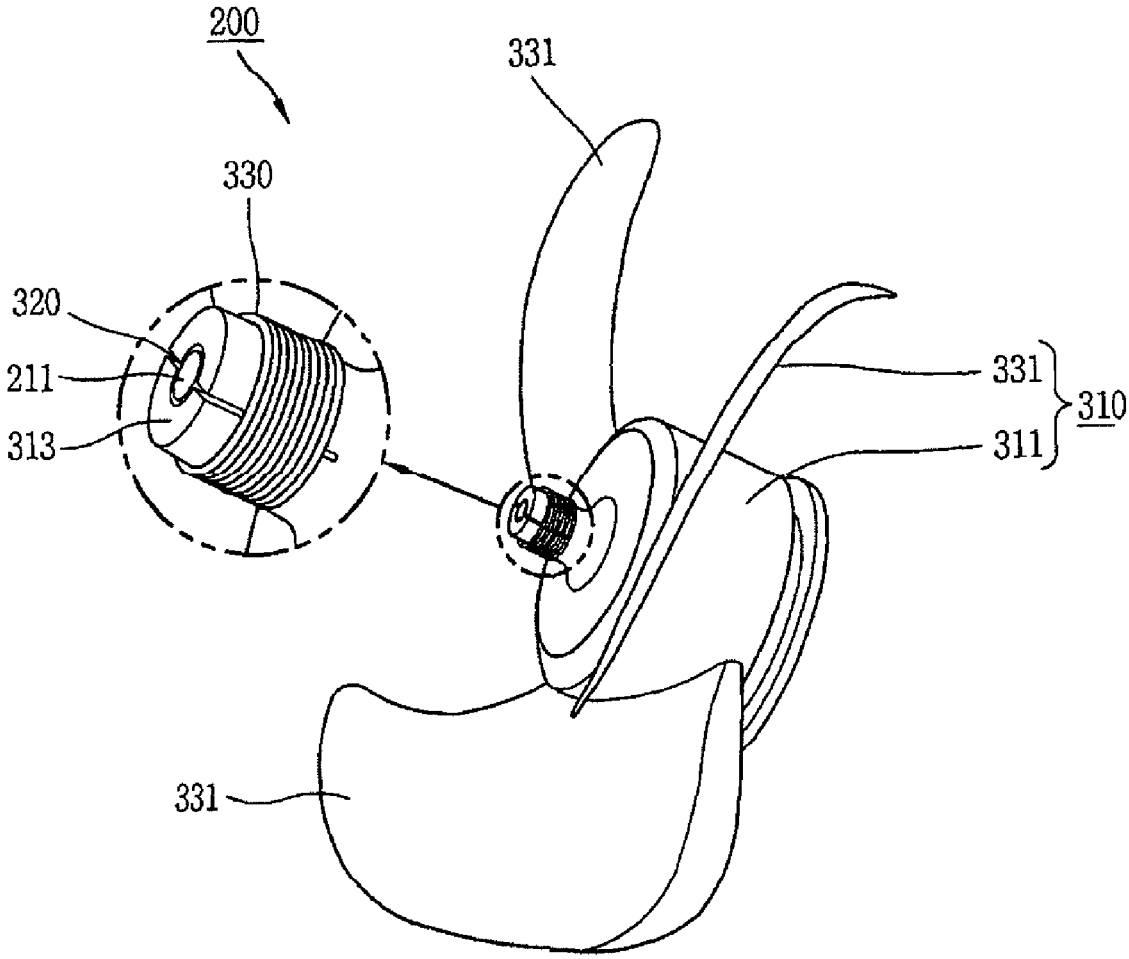
FIG. 4 is a front perspective view of the fan assembly in accordance with a non-limiting embodiment of the present invention.
Figure 5:
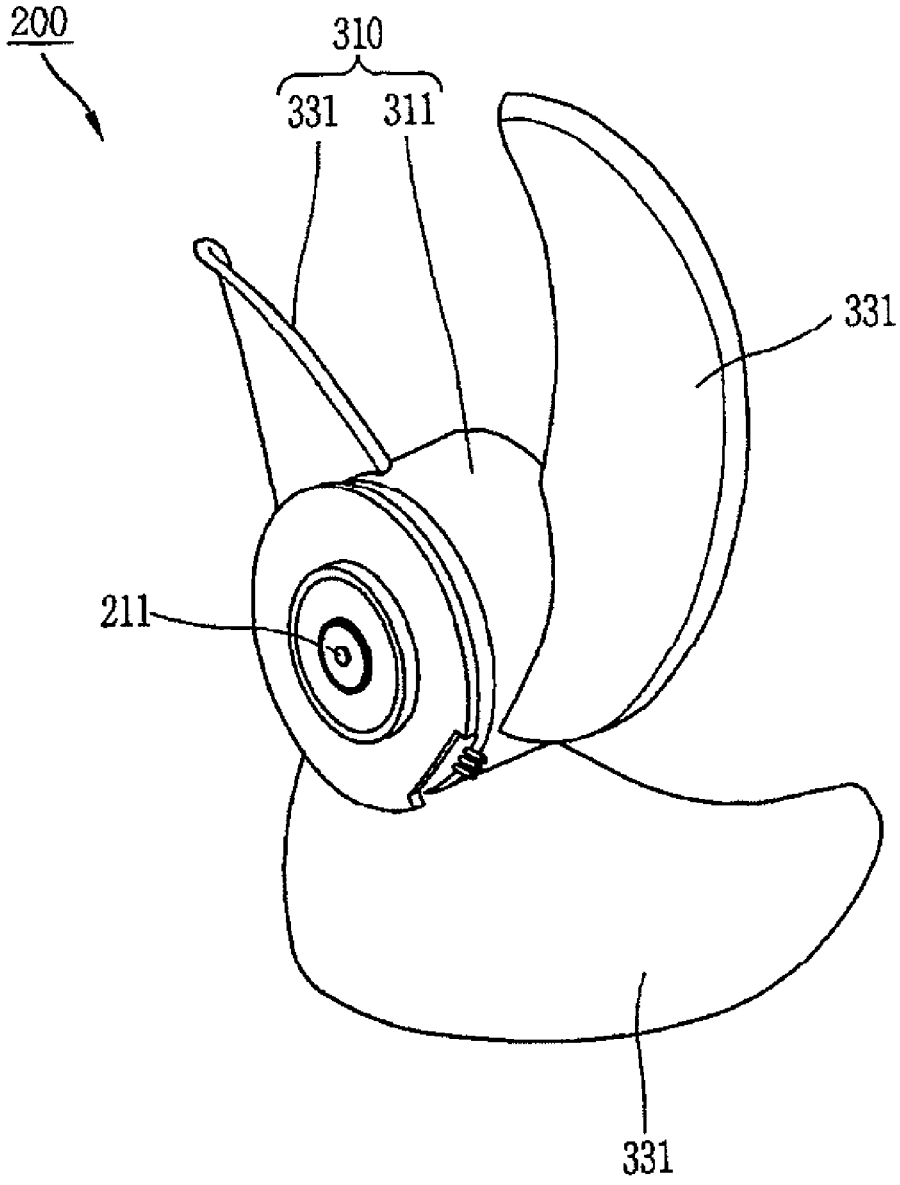
FIG. 5 is a rear perspective view of the fan assembly in accordance with a non-limiting embodiment of the present invention.
Figure 6:
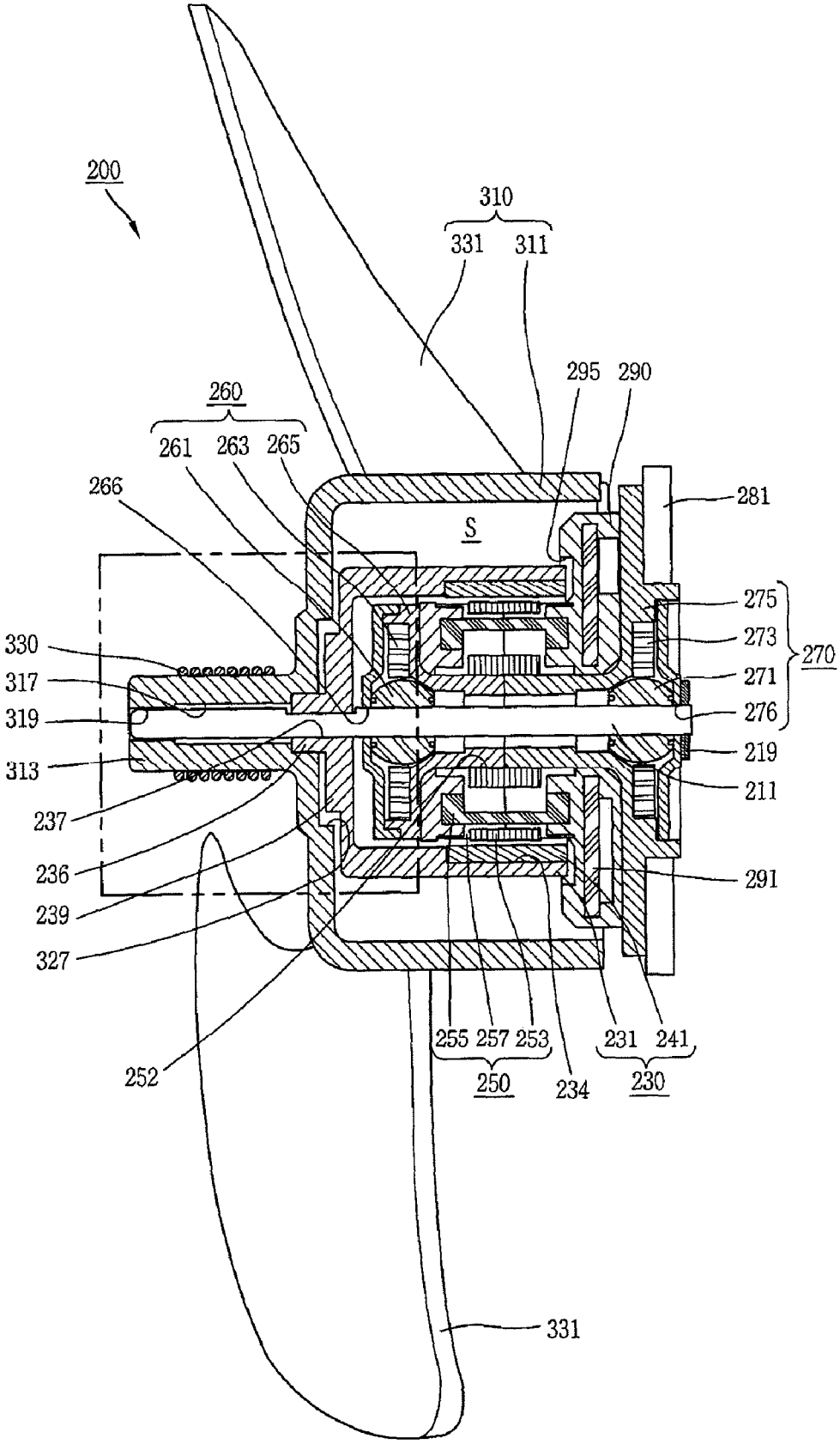
FIG. 6 is a cross-sectional view of the fan assembly in FIG. 3 in accordance with a non-limiting embodiment of the present invention.

As shown in FIGS. 4 through 6, each fan assembly 200 may include a rotation shaft 211, a rotor 230 coupled to the rotation shaft 211, a stator 250 disposed inside the rotor 230, and a fan 310 including a hub 311 having a receiving space therein and a plurality of blades 331 disposed at a circumference of the hub 311, and coupled to the rotation shaft 211 such that the rotor 230 is spaced from an inner surface of the hub 311 respectively in the axial and radial directions.

The fan 310 may be formed of any suitable material, such as a synthetic resin member, and includes the hub 311 having one end thereof open. The hub 311 may be formed in any suitable shape, such as a cylindrical shape, and the blades 331 may protrude from the circumference of the hub 311 in a radial direction and may be spaced from each other in the circumferential direction. The fan 310 is implemented as an axial flow fan for blowing air in an axial direction and is formed to have a propeller shape, although the present invention contemplates other suitable shapes for the fan.

The rotation shaft 211 is disposed at the center of the hub 311 in an axial direction, and first and second bearing assemblies 260, 270 are coupled to the circumference of the rotation shaft 211 so as to rotatably support the rotation shaft 211. A fixing ring 219 is coupled to an end of the second bearing assembly 270 of the rotation shaft 211 so as to prevent the separation of the second bearing assembly 270. The stator 250 is coupled to one region of each of the first and second bearing assemblies 260, 270, and the rotor 230 is disposed at an outer periphery of the stator 250 with a certain air gap therebetween.

The stator 250 may include a stator core 253 and may be formed of laminated (insulated) electrical steel plates (although the present invention also contemplates that the stator core may also be formed by other insulation techniques known to those skilled in the art). A stator coil 255 is wound onto the stator core 253, and an insulator 257 is interposed between the stator core 253 and the stator coil 255 for insulating the stator core 253 and the stator coil 255. A hollow bore 252 is formed in the center of the stator 250 such that the first and second bearing assemblies 260, 270 can be respectively inserted thereinto.

A molding portion 290 for integrally coupling an inner end of the stator 250 and a PCB (Printed Circuit Board) 291 is formed at the inner end of the stator 250 (i.e., shown at the right end in FIG. 6). The molding portion 290 may be formed in any suitable shape, such as a disk-shape with a certain thickness, by using a thermoplastic resin (or any other suitable material) so as to enclose a portion of the inner end of the stator 250 and the PCB 291.

A blocking portion or lip 295 is formed at one side of the molding portion 290 so as to overlap one end of the rotor 230 by a certain length in the axial direction. That is, the blocking portion 295 is extended in the axial direction so as to be spaced from the outer surface of the inner (e.g., right in FIG. 6) end of the rotor 230 by a certain distance. This is to prevent the restriction or forced deterioration caused by introduction of foreign substances, by preventing the introduction of foreign substances at the outside of the rotor 230 into the inside thereof.

Figure 7:
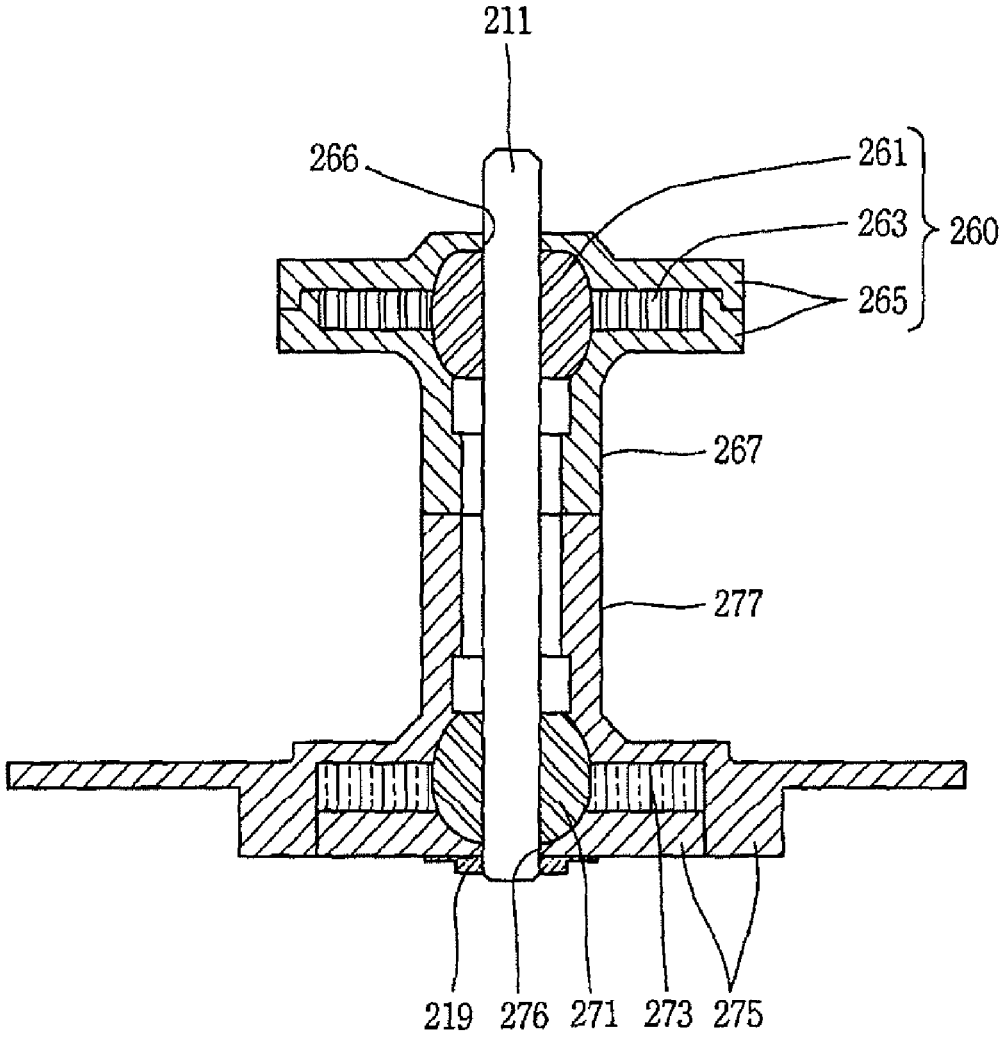
FIG. 7 is an enlarged view of bearing assemblies in FIG. 6 in accordance with a non-limiting embodiment of the present invention.

As shown in FIG. 7, the first and second bearing assemblies 260, 270 may respectively include bearings 261, 271 coupled to the circumference of the rotation shaft 211 for rotatably supporting the rotation shaft 211, felts 263, 273 containing lubricating oil and contacting a circumference of each of the bearings 261, 271, and housings 265, 275 respectively receiving the bearings 261, 271 and the felts 263, 273. The housings 265, 275 are respectively provided with small-diameter neck portions 267, 277 each inserted inside the stator 250. Through-holes 266, 276 are respectively formed in the centers of the bearings 261, 271 and the housings 265, 275 so as to pass the rotation shaft 211 therethrough. The second bearing assembly 270 is supported as one side thereof is press-fitted to a support member 281.

Figure 8:
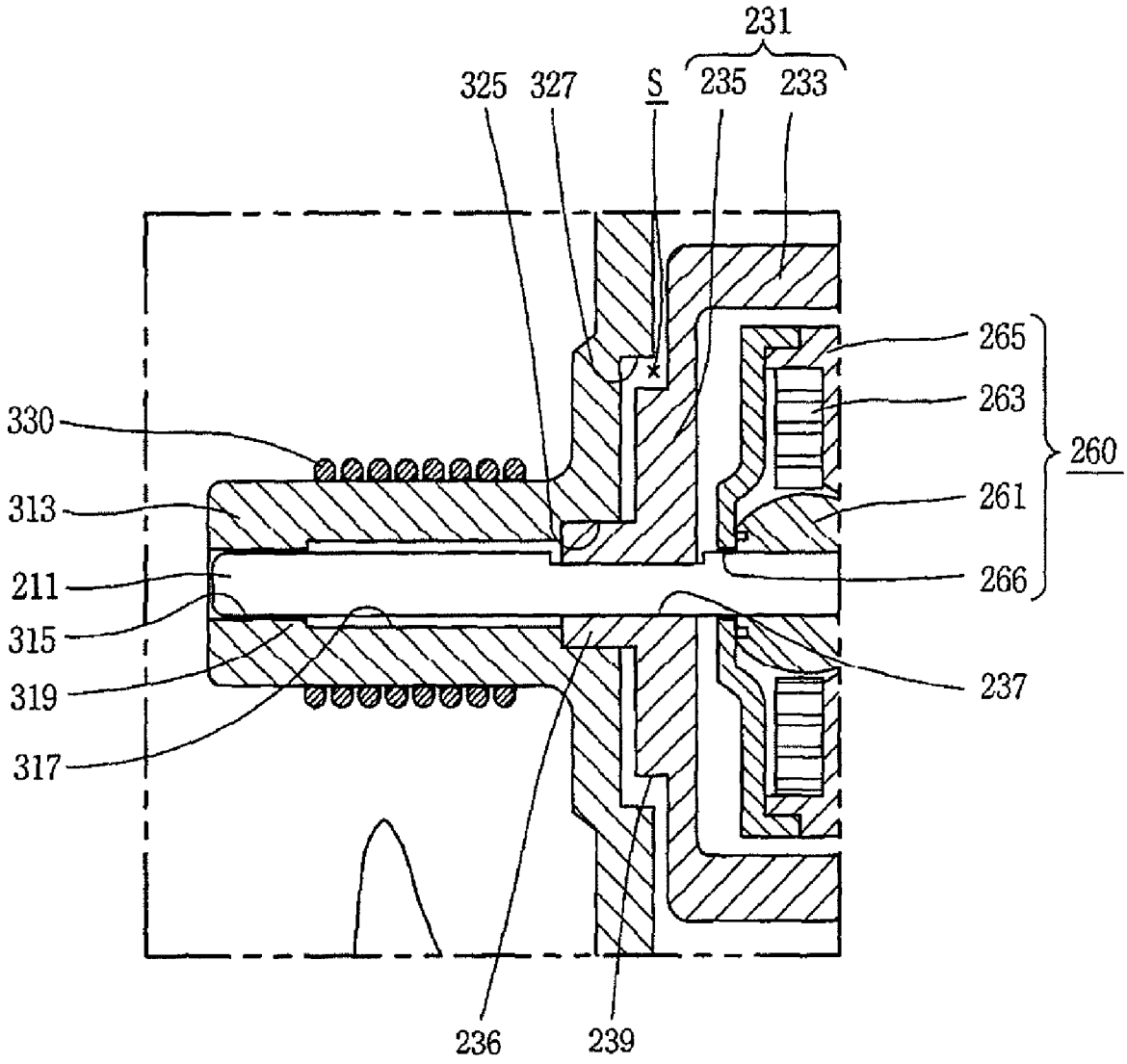
FIG. 8 is an enlarged view illustrating certain parts of the bearing assemblies in FIG. 6 in accordance with a non-limiting embodiment of the present invention.
Figure 9:
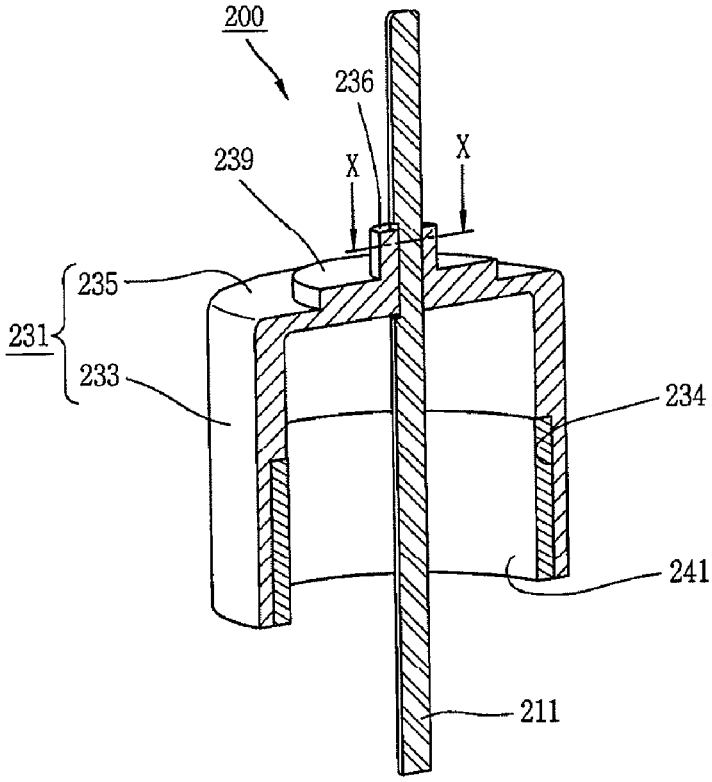
FIG. 9 is a perspective view illustrating a partially cut rotor in FIG. 6 in accordance with a non-limiting embodiment of the present invention.

Referring to FIGS. 8 and 9, the rotor 230 may include a frame 231 formed to have a cylindrical shape (although other suitable shapes are contemplated by the present invention) and having one end thereof integrally coupled to the rotation shaft 211 so as to be rotated, and a permanent magnet 241 coupled inside the frame 231. A permanent magnet coupling portion 234 recessed in a radial direction is formed in the inner circumferential surface of a cylindrical portion 233 of the frame 231 so as to couple the permanent magnet 241 therein. This is to facilitate the coupling of the permanent magnet 241 to the frame 231, when the permanent magnet 241 is to be coupled, without requiring much attention to the position of the stator 250. In addition, the axial positions of the permanent magnet 241 and the stator 250 are aligned with each other, thus preventing a performance degradation due to a deviation in their relative positions in the axial direction.

The frame 231 may include a disk portion 235 disposed to close one end of the cylindrical portion 233. An axially protruding collar portion 236 is formed at a center of an outer surface of the disk portion 235, and a radially extending stepped portion 239 is formed extending radially outwardly of the protruding collar portion 236. A shaft receiving hole 237 for receiving the rotation shaft 211 therein is formed in the center of the protruding collar portion 236.

The hub 311 is formed to have a cylindrical shape (although other suitable shapes are contemplated by the present invention) having one end thereof open so as to form a receiving space therein. An inner diameter of the hub 311 is larger than an outer diameter of the frame 231 such that a vibration isolation space S can be provided between the frame 231 and the hub 311. A shaft coupling collar portion 313 extending outwardly in an axial direction is disposed at a central portion of the outer end surface of the hub 311 so as to enable coupling of the rotation shaft 211 thereto.

A shaft bore hole 315 for accommodating the rotation shaft 211 therein extends axially through the center of the shaft coupling collar portion 313. A non-contact clearance space 317 is formed inside the shaft coupling collar portion 313 and extends outwardly in a radial direction so as to have a greater inner diameter as compared to the shaft bore hole 315 and thus avoids contact with the rotation shaft 211. The non-contact clearance space 317 is disposed so as to be spaced longitudinally inwardly from an outer end of the shaft coupling collar portion 313 by a certain distance in the axial direction, whereby a contact portion 319 for contacting the outer diameter surface of the rotation shaft 211 is formed at the outer end of the shaft coupling collar portion 313. A slot 320 (see e.g., FIG. 4) is cut in the transverse and axial directions in the outer end of the shaft coupling collar portion 313 for enabling an inward elastic deformation of the outer end of the shaft coupling collar portion 313 towards the shaft bore hole 315. More than one slot 320 may be formed.

An insertion bore 325 for receiving the protruding collar portion 236 of the frame 231 therein is formed at an inner end of the non-contact clearance space 317 extending inwardly in the axial direction. Here, the protruding collar portion 236 is formed to have a longer length in the axial direction compared to that of the insertion bore 325. This is to secure the vibration isolation space S by spacing the disk end portion 235 of the frame 231 from an inner surface of the end of the hub 311. The insertion bore 325 is formed so that the protruding collar portion 236 can be tightly inserted (e.g., press-fitted) thereinto. A larger diameter clearance recess 327 is formed in the inner end surface of the end of the hub 311 concavely in an axial direction and extending in a radial direction at one end of the insertion bore 325. This enables the stepped portion 239 of the frame 231 to be accommodated while being spaced from the clearance recess 327 with the vibration isolation space S therebetween.

A coupling member 330 for urging the shaft coupling collar portion 313 into contact with the rotation shaft 211 and the protruding collar portion 236 of the frame 231 is coupled to an outer surface of the shaft coupling collar portion 313. The coupling member 330 is formed to have elasticity and may be implemented as a helical spring, although other suitable elastic members are also contemplated by the present invention. Preferably, the coupling member 330 is disposed outside the non-contact clearance space 317 since the reduction of the coupling force (binding force) acting between the shaft coupling collar portion 313 and the rotation shaft 211 and between the shaft coupling collar portion 313 and the frame 231 can thereby be prevented.

Figure 10:
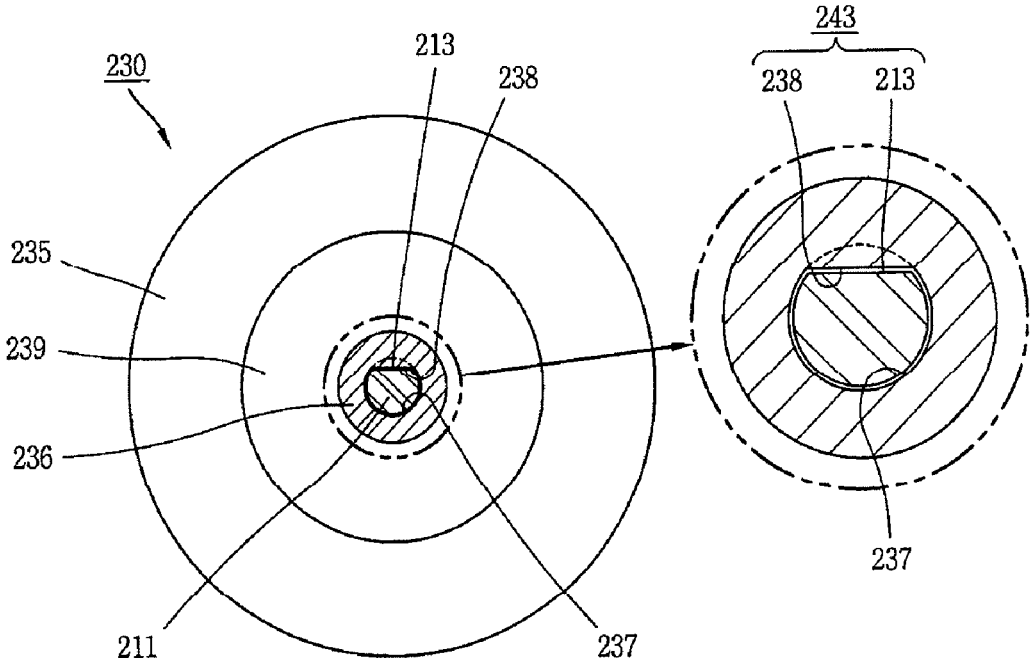
FIG. 10 is a cross-sectional view taken along line 'X-X' in FIG. 9.

Referring to FIGS. 9 and 10, a rotation-preventing coupling arrangement 243 is provided between the rotation shaft 211 and the frame 231 for preventing a relative rotation therebetween. The rotation-preventing coupling arrangement 243 may include a flat surface 213 cut (e.g., ground) into the outer surface of the rotation shaft 211, and a flat side wall 238 formed at the shaft receiving hole 237 for surface-contacting the frame 231 to the flat surface 213 by injection-molding the frame 231 onto the rotation shaft 211. Accordingly, both the relative rotation and separation of the frame 231 from the rotation shaft 211 can be prevented during its use.

Figure 11:
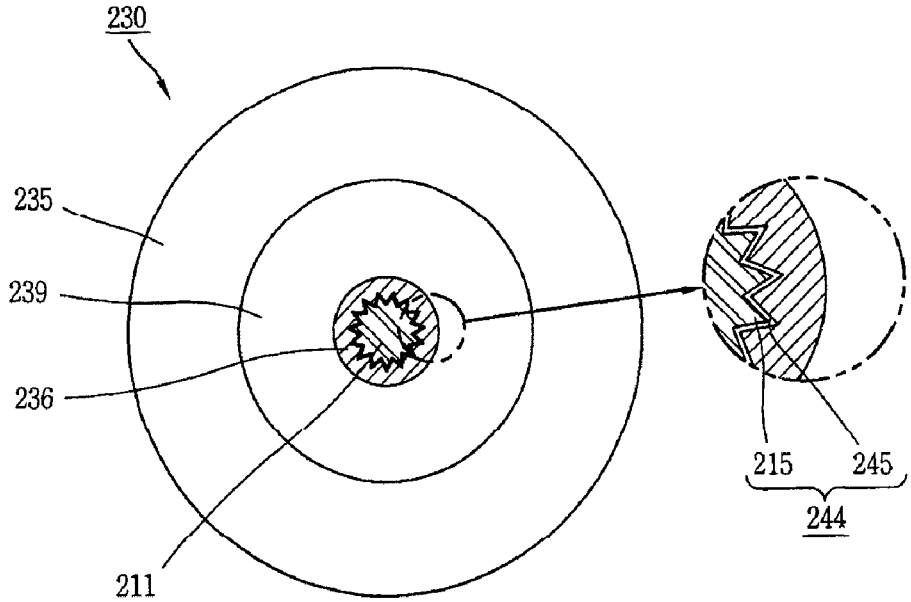
FIG. 11 is a cross-sectional view illustrating a rotation-preventing portion as shown in FIG. 6 and FIG. 10 in accordance with a non-limiting embodiment of the present invention.

As shown in FIG. 11, an alternative rotation-preventing coupling arrangement 244 may be provided by an externally splined portion 215 formed by involute or triangular external splines on the rotation shaft 211, and a corresponding internally splined portion 245 formed at the shaft receiving hole 237 to be movable in an axial direction and restricted in a rotational direction when the internally splined portion 215 is inserted onto the rotation shaft 211.

Figure 12:
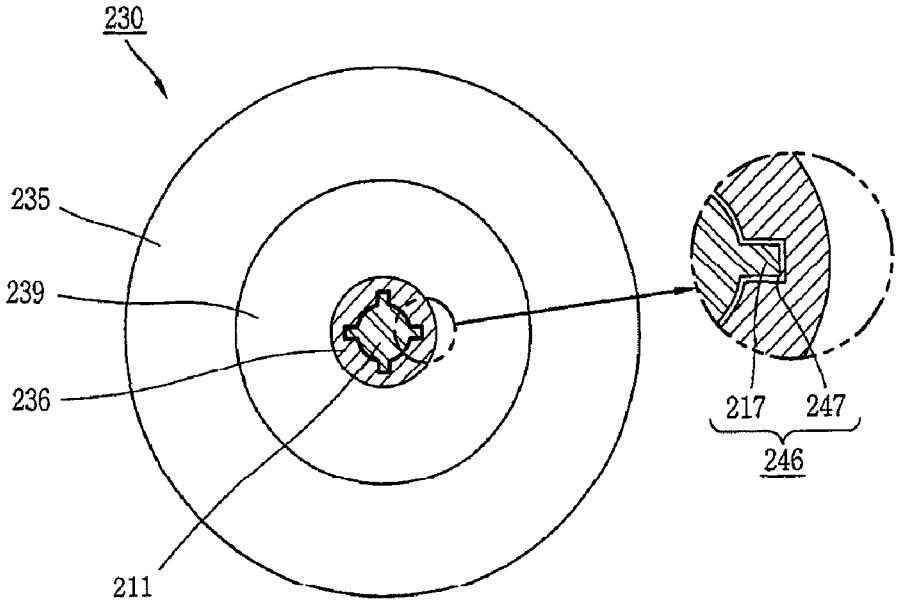
FIG. 12 is a cross-sectional view illustrating an alternative rotation-preventing portion as shown in FIG. 6 and FIG. 10 in accordance with another non-limiting embodiment of the present invention.

As shown in FIG. 12, an alternative rotation-preventing coupling arrangement 246 may be provided by a plurality of straight tooth splines 217 protruding outwardly from the rotation shaft 211 in a radial direction, and square slots 247 for receiving the splines 217 being formed in the walls of the shaft receiving hole 237 in the frame 231. When the rotation-preventing coupling arrangements 244, 246 in FIGS. 11 and 12 are to be implemented, the frame 231 may be injection-molded integrally onto the rotation shaft 211, or separately manufactured and then coupled to the shaft 211.

Accordingly, when electrical power is applied to the stator coil 255, the electromagnetic force generated by the stator coil 255 and the magnetic force of the permanent magnet 241 interact with each other, thereby rotating the rotor 230 and the fan 310 centering around the rotation shaft 211. In this regard, the frame 231 of the rotor 230 is spaced apart from the hub 311 of the fan 310 in the radial and axial directions, thereby preventing the transfer of vibration of the permanent magnet 241. When the fan 310 and the rotor 230 are rotated, the blocking portion 295 prevents infiltration of foreign substances from outside of the frame 231 into the inside thereof. The coupling member 330 applies an elastic force from the outside of the non-contact space 317 such that reduction in the coupling force acting between the shaft coupling collar portion 313 and the rotation shaft 211 and between the shaft coupling collar portion 313 and the protruding collar portion 236 of the frame 231 can be prevented.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

As described above, in accordance with a non-limiting embodiment of the present invention, the rotor and the fan are coupled to be spaced apart from each other, thereby preventing the transfer of the vibration of the rotor to the fan when the fan assembly is rotated. The rotor and fan coupling also prevents a reduction in the durability of the constituting elements and prevents the generation of noise caused by emanation of the vibration of the rotor.

In addition, in accordance with a non-limiting embodiment of the present invention, a rotation-preventing coupling portion is arranged between the frame and the rotation shaft, and thus, even if the period for use has passed, the occurrence of relative rotation of the frame with respect to the rotation shaft is prevented.

In addition, in accordance with a non-limiting embodiment of the present invention, the permanent magnet coupling portion is extended and cut-out such that the permanent magnet can be coupled inside the frame, thereby enabling an operator to easily couple the permanent magnet to the frame as well as preventing a performance degradation since the centers of the permanent magnet and the stator are aligned with each other in the axial direction.

Further, according to the present invention, the frame may be injection-molded integrally with the rotation shaft, thereby not requiring a separate process of coupling the rotation shaft and the frame, and when coupling, preventing occurrence of an eccentricity of the rotation shaft and the frame due to an error and/or tolerance.

Further, according to the present invention, the fan is provided with the shaft coupling collar portion having the non-contact clearance space therein such that the contact portion of the shaft coupling collar portion contacting the rotation shaft and the contact portion contacting the frame are spaced from each other in the axial direction, and the contact area with the rotation shaft is reduced, thereby enhancing the coupling force between the fan and the rotation shaft as well as effectively preventing the vibration transfer.

Further, according to the present invention, the shaft coupling collar portion is slotted at its end in the axial direction, thereby enabling urging of the shaft coupling collar portion into contact with the rotation shaft, thus to enhance the coupling force.

Further, according to the present invention, the coupling member is disposed outside the non-contact space, thereby continually applying an elastic force urging the shaft coupling collar portion into contact with the rotation shaft. Accordingly, the fan and the rotation shaft can be firmly coupled to each other.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to several exemplary embodiments, it is understood that the words that have been used are words of description and illustration, rather than words of limitation. As the present invention may be embodied in several forms without departing from the spirit or essential characteristics thereof, it should also be understood that the above-described embodiments are not limited by any of the details of the foregoing description, unless otherwise specified. Rather, the above-described embodiments should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. A fan assembly, comprising:

a rotation shaft;

a rotor coupled to the rotation shaft;

a stator disposed inside the rotor; and a fan including a hub having a receiving space therein and a plurality of blades disposed around a circumference of the hub, and coupled to the rotation shaft such that the rotor is spaced from an inner surface of the hub in axial and radial directions, wherein the rotor comprises a frame having one end thereof open, and a permanent magnet disposed inside the frame, wherein an inner diameter of the hub is larger than an outer diameter of the frame such that a vibration isolation space is provided between the frame and the hub, wherein a protruding collar portion protrudes outwardly in an axial direction and is provided at a closed end of the frame, and an insertion bore that receives the protruding collar portion therein is provided inside the hub, and wherein the protruding collar portion is configured to have a longer length in the axial direction compared to a length in the axial direction of the insertion bore so as to secure the vibration isolation space by spacing the frame from an inner surface of the hub.

2. The fan assembly of claim 1, wherein a rotation-preventing coupling portion that prevents a relative rotation of the frame with respect to the rotation shaft is provided at the rotation shaft.

3. The fan assembly of claim 1, wherein the frame is injection-molded on the rotation shaft.

4. The fan assembly of claim 1, wherein a permanent magnet coupling portion extending in a radial direction is provided in an inner surface of the frame proximate the open end thereof so as to couple the permanent magnet to the rotor.

5. The fan assembly of claim 1, wherein a stepped portion protruding in an axial direction is provided at an outer surface of a closed end of the frame so as to have a smaller external diameter than that of the frame.

6. The fan assembly of claim 5, wherein a recessed receiving portion is provided in an inner surface of the hub so as to correspond to the stepped portion.

7. The fan assembly of claim 5, wherein a shaft coupling collar portion protruding in an axial direction is provided at the hub so as to receive an end of the rotation shaft for coupling therewith.

8. A refrigerator having a fan assembly according to claim 1.

9. A fan assembly, comprising:

a rotation shaft;

a rotor coupled to the rotation shaft;

a stator disposed inside the rotor; and a fan including a hub having a receiving space therein and a shaft coupling collar portion protruding in an axial direction at one end thereof so as to be coupled to the rotation shaft, and a plurality of blades disposed around a circumference of the hub, and coupled to the rotation shaft such that the rotor is spaced from an inner surface of the hub in axial and radial directions, wherein the rotor comprises a frame having one end thereof open, and a permanent magnet disposed inside the frame, wherein an inner diameter of the hub is larger than an outer diameter of the frame such that a vibration isolation space is provided between the frame and the hub, wherein a protruding collar portion protrudes outwardly in an axial direction and is provided at a closed end of the frame, and an insertion bore that receives the protruding collar portion therein is provided inside the hub, and wherein the protruding collar portion is configured to have a longer length in the axial direction compared to a length in the axial direction of the insertion bore so as to secure the vibration isolation space by spacing the frame from an inner surface of the hub.

10. The fan assembly of claim 9, wherein the shaft coupling collar portion is slotted at an end portion thereof.

11. The fan assembly of claim 9, wherein a non-contact clearance space is provided inside the shaft coupling collar portion such that an inner surface of the shaft coupling collar portion is spaced from an outer surface of the rotation shaft.

12. The fan assembly of claim 11, further comprising:

a coupling member elastically coupled to the shaft coupling collar portion and applying an elastic force urging the shaft coupling collar portion into contact with the rotation shaft.

13. The fan assembly of claim 12, wherein the coupling member is coupled to an outside of the non-contact clearance space.

14. A refrigerator having a fan assembly according to claim 9.

15. A fan assembly, comprising:

a rotation shaft;

a rotor coupled to the rotation shaft;

a stator disposed inside the rotor; and a fan including a hub having a receiving space therein and a plurality of blades disposed around a circumference of the hub, the fan coupled to the rotation shaft such that the rotor is spaced from an inner surface of the hub in axial and radial directions, wherein a shaft coupling collar portion is disposed at a central portion of the hub so as to enable coupling of the rotation shaft, and the shaft coupling collar portion having a shaft bore hole for accommodating the rotation shaft therein.

16. The fan assembly of claim 15, wherein at least a slot is cut in the transverse and axial directions in the outer end of the shaft coupling collar portion for enabling an inward elastic deformation of the outer end of the shaft coupling collar portion towards the shaft bore hole.

17. The fan assembly of claim 16, further comprising a coupling member for urging the shaft coupling collar portion into contact with the rotation shaft, the coupling member implemented as a helical spring.

* * * * *